United States Patent [19]

Boyd

[11] 4,143,979

[45] Mar. 13, 1979

[54] PRINTHEAD NEEDLE CAP

[75] Inventor: Alfred K. Boyd, Houston, Tex.

[73] Assignee: Texas Instruments Incorporated, Dallas, Tex.

[21] Appl. No.: 793,571

[22] Filed: May 4, 1977

[51] Int. Cl.[2] ..... B41J 3/10

[52] U.S. Cl. ..... 400/124; 101/93.05

[58] Field of Search ..... 101/93.05, 93.48; 197/1 R; 400/124, 686

[56] References Cited

U.S. PATENT DOCUMENTS 3,929,214 12/1975 Hebert ..... 101/93.05 X

FOREIGN PATENT DOCUMENTS 2352698 5/1974 Fed. Rep. of Germany ..... 197/1 R

*Primary Examiner*—Paul T. Sewell

*Attorney, Agent, or Firm*—Rene' E. Grossman; Leo N. Heiting; Thomas G. Devine

[57] ABSTRACT

A print member of the printhead of a ballastic type wire matrix printer terminates in an impression end and in an activation end. A cap is formed at the activation end for contact by the blade-like armature of an activating electromagnet. A tip is formed at the activating end of the member with a first layer of a relatively stiff plastic material affixed to and surrounding the tip and a second layer of relatively tough and abrasion resistive plastic material is affixed to the first layer and positioned to be contacted by the armature.

8 Claims, 3 Drawing Figures

10
38
37
11
12
40
30

PRINTHEAD NEEDLE CAP

BACKGROUND OF THE INVENTION

1. Field of the Invention

This invention relates to the print members of the printhead of a wire matrix printer. More specifically, it relates to the structure of the cap at the actuation end of the print member of a ballastic-type matrix printhead.

2. Description of the Prior Art

Prior art print members for ballastic-type matrix printers provide metal caps to be contacted by the armature of an activated electromagnet to drive the other end of the print member against the print medium. Such metal caps have been extremely noisy and not durable.

Still other prior art print members have tips formed at the activation end of the member and have a layer of plastic material affixed around the tip. Such plastic material may have characteristics of being tough and abrasion resistive, but not stiff and therefore pre-mature breakage of the formed tip occurs, due to repeat cycle stresses.

Another type of print member has a tip at the actuation end covered by a plastic material that is very stiff, but not particularly tough or resistant to abrasion. A cap formed of such material is subject to premature wear.

This invention combines the features of both of the above mentioned plastic materials and therefore provides stiffness, toughness and high abrasion resistivity.

BRIEF SUMMARY OF THE INVENTION

The primary object of this invention is to provide a long lived print member for the printhead of a ballistic type wire matrix printer.

Another object of this invention is to provide a print member that has a cap, to be contacted by the armature of an electromagnet, that is extremely stiff, tough and resistive to abrasion.

These and other objects will be made evident in the detailed description that follows.

DETAILED DESCRIPTION OF THE INVENTION

Figure 1:
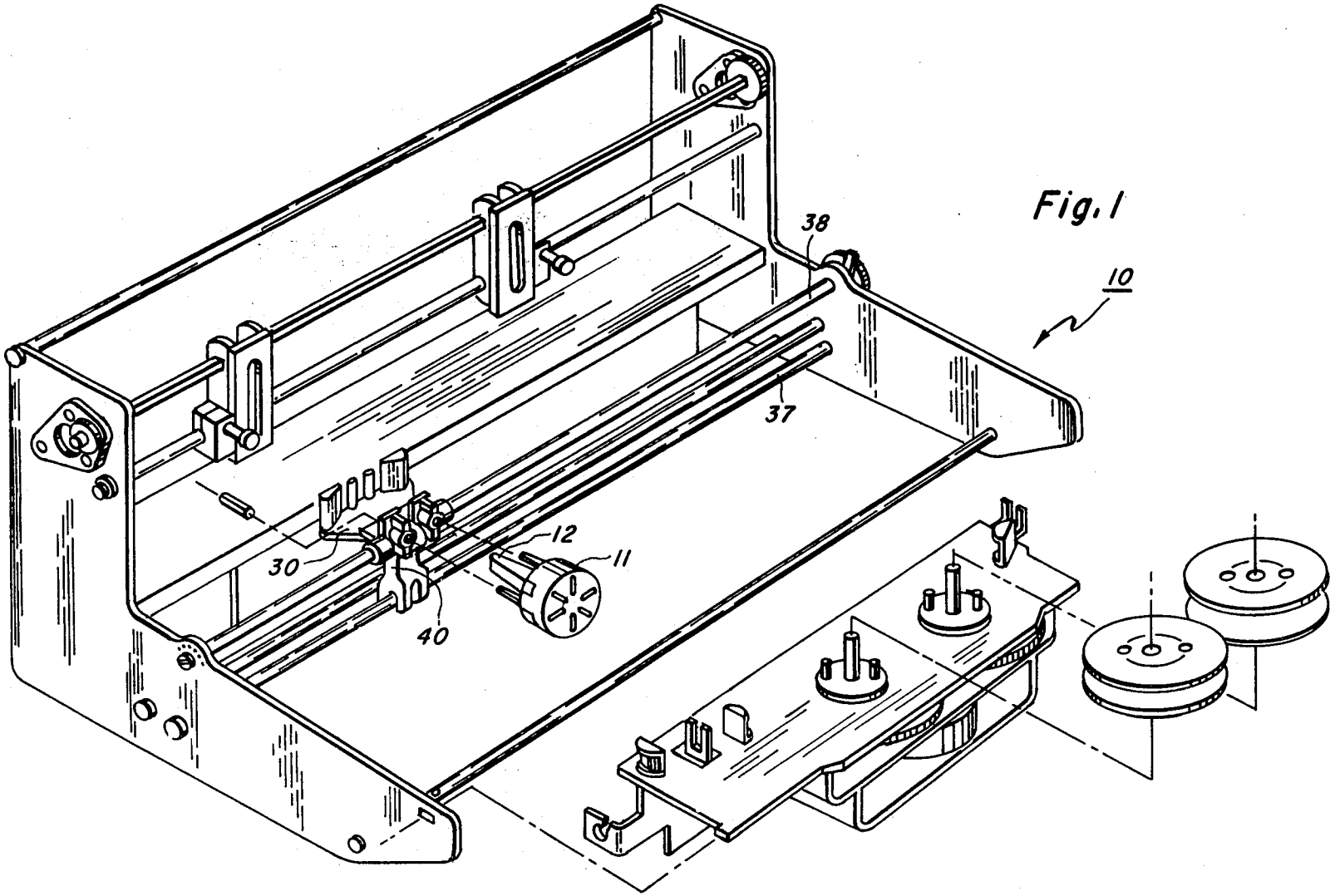
FIG. 1 is a partially exploded view of the inner framework assembly of the wire matrix impact printer.

FIG. 1 shows the inner framework 10 of the wire matrix impact printer of the preferred embodiment of this invention. The preferred printer is the Model 810 from Texas Instruments Incorporated, Dallas, Texas. Details of the operation, construction, and circuitry of the Model 810 printer are available in Texas Instruments Incorporated publications "Operating Instructions for Model 810 Printer" — No. 994,353- 9701 and "Model 810 Printer Maintenance Manual" — No. 994,386- 9701. Wire matrix printhead 11 having an impression end 12 is shown as it is attached to carriage assembly 40. The carriage is moved from left to right and from right to left by a cable mechanism (not shown) driven by an electric motor (not shown).

Figures 2, 3:
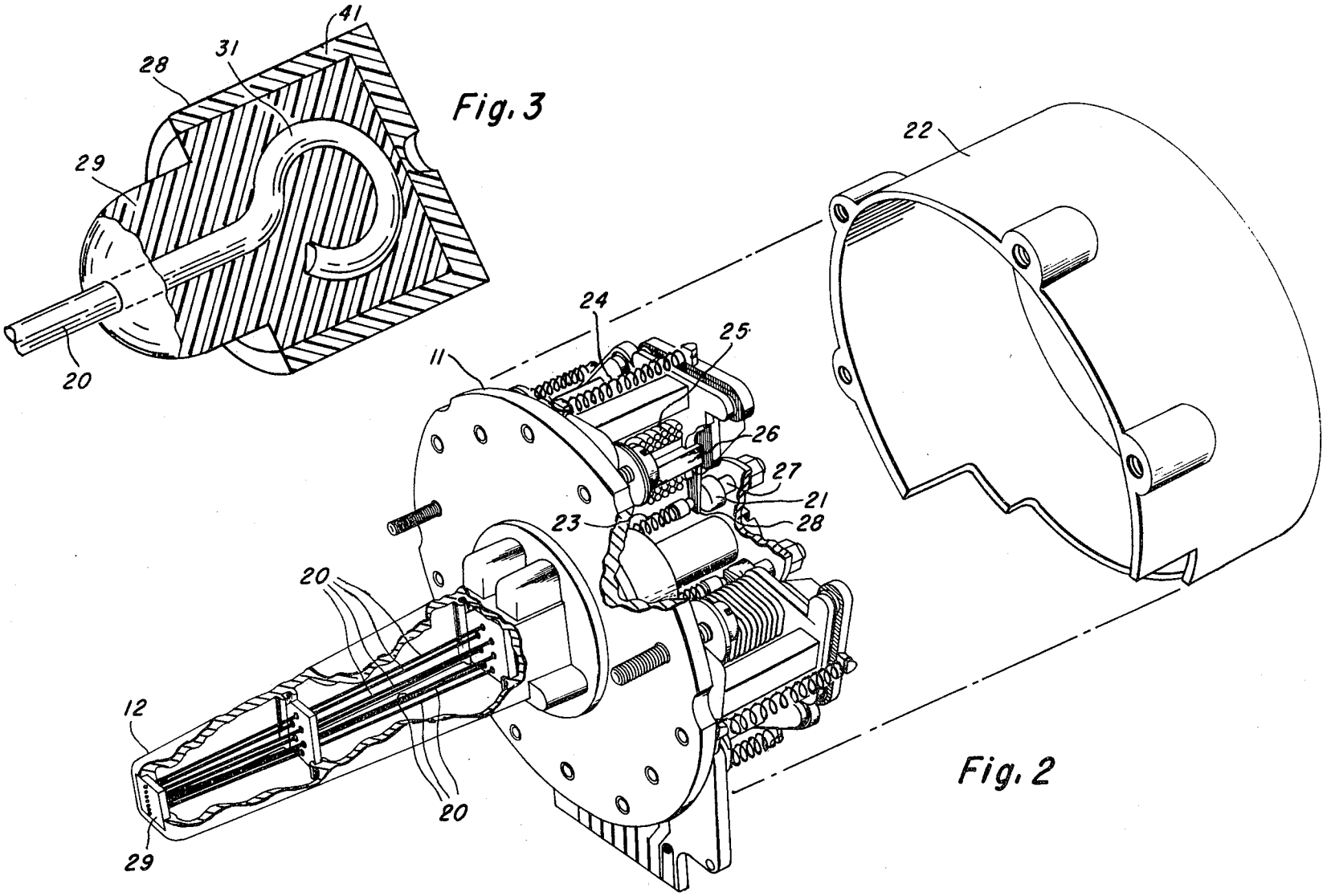
FIG. 2 is an exploded view of the printhead of the wire matrix printer.
FIG. 3 is a section, in perspective, of the impact end of the print member.

FIG. 2 shows the printhead 11 in detail. The print members are made up of the needles 20, one of which is shown terminating in needle cap 28. In this preferred embodiment, 7 needles 20 are illustrated and their terminations are identical so that the description of one will be identical to the others and will therefore suffice. Needle 20 is surrounded by spring 23 which urges the needle cap 28 in a direction toward armature 26 of electromagnet 25. Tension spring 24 is attached to armature 26 for the purpose of moving it back into position after activation by electromagnet 25 has ceased. Protrusion 27 (greatly exaggerated) is simply a raised portion caused by the process of the manufacture of the cap 28. The needles 20 pass through the head 11 into the impression end 12 and out through the respective holes in bezel 29 against which the print medium passes and which is contacted by the activated needles 20. Printhead cover 22 is shown disassembled.

FIG. 3 shows a sectional perspective of the needle cap and needle 20. In this preferred embodiment, an arcuate loop 31 forms the tip of the print member assembly. A metal cap may be substituted for the arcuate loop. A first layer 29 is shown and is a very stiff plastic material covered by a second layer 41 which is a plastic material that is very tough and highly resistive to abrasion.

In this preferred embodiment, the first layer 29 is formed of acetal copolymer and is specifically Celcon* M270, manufactured by Celanese Plastics Company and having a flexural modulus in the order of 350,000 p.s.i. The second layer is a thermoplastic urethane elastomer, sometimes known as "elastoplastic". It is specifically Cyanaprene 1857, manufactured by American Cyanamide Company. The needle 20** is made, typically, of tungsten or of carbon steel.

* Trademark of Celanese Plastic Company

** Trademark of American Cyanamide Company

Those skilled in the art know that many other plastic materials can be substituted for those mentioned above without departing from the scope and spirit of this invention. Likewise, the tip formation at the actuation end of the needle may be made in many configurations before being coated with the first and second layers of plastic materials, also without departing from the spirit and scope of this invention.

What is claimed is:

1. A ballastic wire matrix printhead for a multicopy printer including a body, at least one electromagnet mounted within the body and having a blade-like armature, and at least one print member having an actuation and selectively contacted by the armature and having an impression end for contacting a print medium, the print member comprising:

(a) a needle terminating in the activation end and in the impression end;

(b) a first layer of stiff plastic material affixed to and surrounding the activation end of the needle; and (c) a second layer of tough and abrasion resistive plastic material affixed to the first layer and positioned to be contacted by the armature.

2. A ballastic wire matrix printhead for a multicopy printer including a body, at least one electromagnet mounted within the body and having a blade-like armature, and at least one print member having an activation end selectively contacted by the armature and having an impression end for contacting a print medium, the print member comprising:

(a) a needle, terminating in the activation end and the impact end;

(b) a tip, formed on the activation end;

(c) a first layer of stiff plastic material affixed to and surrounding the tip; and (d) a second layer of tough and abrasion resistive plastic material affixed to the first layer and positioned to be contacted by the armature.

3. The print member of claim 2 wherein the tip is a metal cap.

4. The print member of claim 2 wherein the tip is the activation end of the needle bent into an arcuate form.

5. The print member of claim 1 wherein the first layer is an acetal copolymer having a flectural modulus in the order of 350,000 psi and the second layer is a thermoplastic urethane elastomer.

6. The print member of claim 2 wherein the first layer is an acetal copolymer having a flectural modulus in the order of 350,000 psi and the second layer is a thermoplastic urethane elastomer.

7. The print member of claim 3 wherein the first layer is an acetal copolymer having a flectural modulus in the order of 350,000 psi and the second layer is a thermoplastic urethane elastomer.

8. The print member of claim 4 wherein the first layer is an acetal copolymer having a flectural modulus in the order of 350,000 psi and the second layer is a thermoplastic urethane elastomer.

* * * * *